United States Patent [19]

Petterson

[11] 4,087,026

[45] May 2, 1978

[54] BARRIER PACKAGE

[76] Inventor: Tor H. Petterson, 31248 Palos Verdes Dr. West, Palos Verdes Peninsula, Calif. 90274

[21] Appl. No.: 619,664

[22] Filed: Oct. 6, 1975

Related U.S. Application Data

[63] Continuation-in-part of Ser. No. 384,700, Aug. 1, 1973, abandoned, which is a continuation-in-part of Ser. No. 180,790, Sep. 15, 1971, abandoned.

[51] Int. Cl.[2] ..... B65D 83/14

[52] U.S. Cl. ..... 222/386.5

[58] Field of Search ..... 222/386.5, 94, 211, 222/215; 117/6; 220/63 R; 141/20

[56] References Cited

U.S. PATENT DOCUMENTS

| | | | |
|---|---|---|---|
| 3,361,303 | 1/1968 | Jacuzzi | 222/215 X |
| 3,393,842 | 7/1968 | Bruce et al. | 222/464 X |
| 3,471,064 | 10/1969 | Micallef | 222/211 |
| 3,471,349 | 10/1969 | Cohen et al. | 222/386.5 X |
| 3,620,420 | 11/1971 | Normos | 222/386.5 |
| 3,945,539 | 3/1976 | Sossong | 222/386.5 |
| 3,981,418 | 9/1976 | Williamson et al. | 222/386.5 |

FOREIGN PATENT DOCUMENTS

| | | |
|---|---|---|
| 1,189,450 | 4/1970 | United Kingdom. |

*Primary Examiner*—Stanley H. Tollberg
*Assistant Examiner*—John P. Shannon
*Attorney, Agent, or Firm*—Lyon & Lyon

[57] ABSTRACT

A low cost barrier package that can be manufactured on presently available equipment having a formed-in-place, controlled release coating integral with the inner surface of the package and substantially free from air entrapment. Total evacuation of the product to be dispensed is effected by controlled deformation of the barrier formed. Permeability is controlled and high speed, high pressure filling processes can be used.

3 Claims, 23 Drawing Figures

TENSILE/SHEAR STRENGTH

REQUIRED DURING FILLING

— — — — Integral controlled release coating
——— Unsupported bag
(a) propellant injection point

TENSILE/SHEAR STRENGTH REQUIRED AT VARIOUS

FILL LEVELS UNDER DROP TEST CONDITIONS

— — — — Integral controlled release coating
——— Unsupported bag

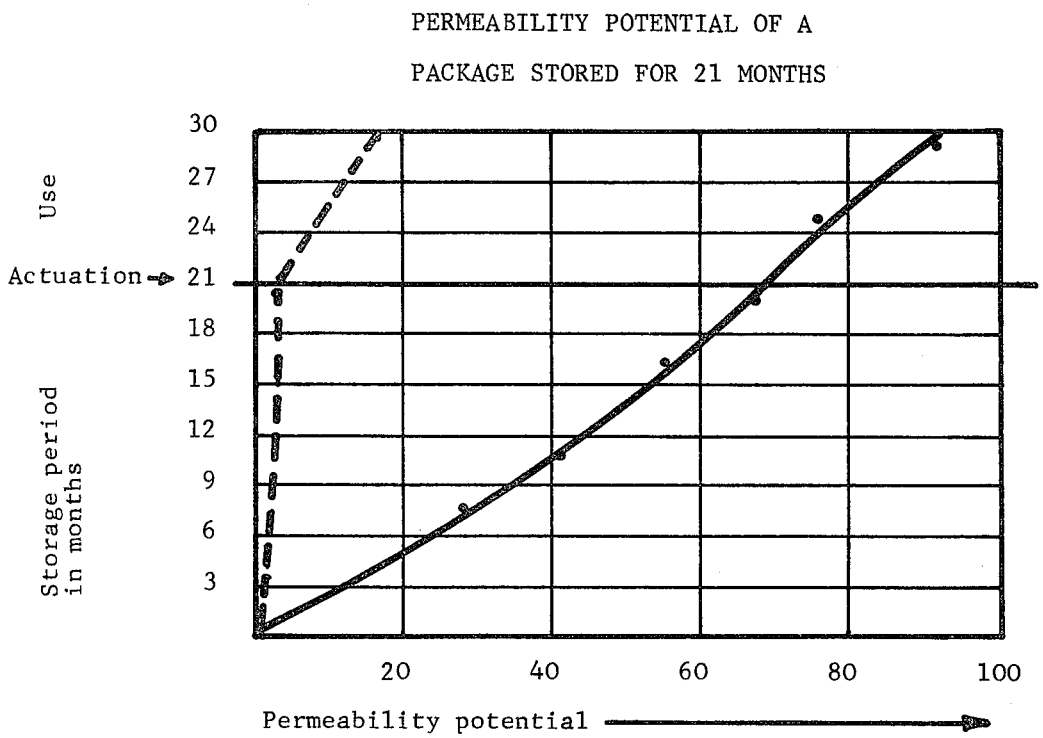
Fig.22 ------ Integral controlled release coating
——— Unsupported bag systems
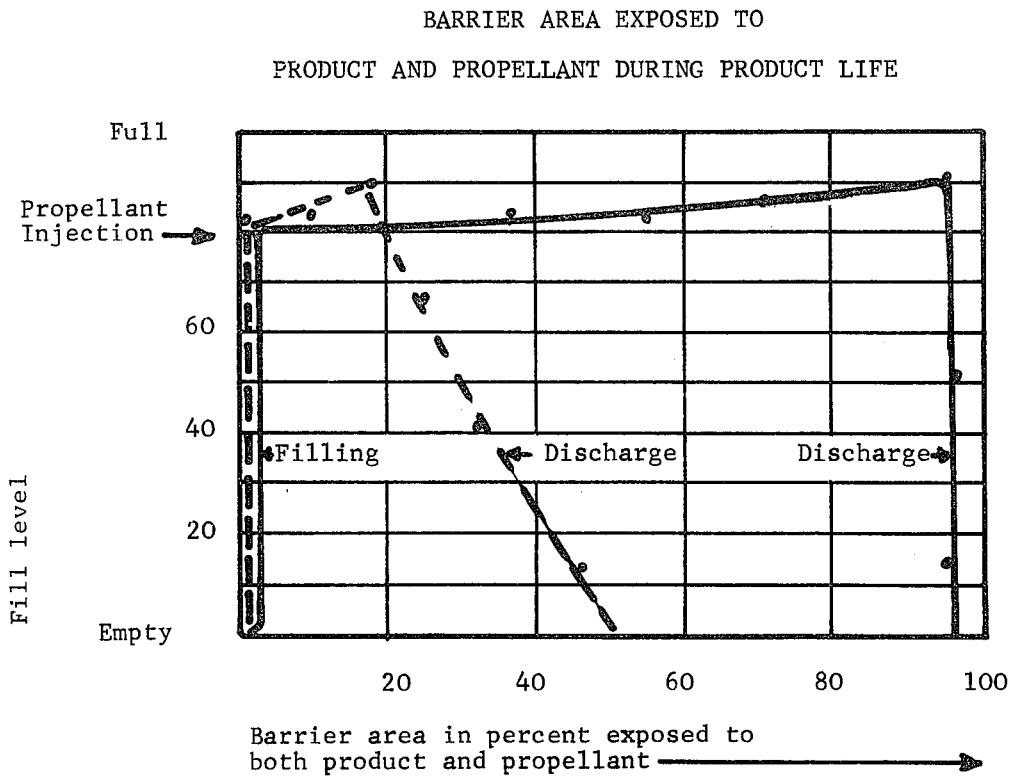
Fig.23 ------ Integral controlled release coating
——— Unsupported bag or bellows system

BARRIER PACKAGE

This application is a continuation-in-part of patent application Ser. No. 384,700, filed Aug. 1, 1973, entitled BARRIER PACKAGE (now abandoned) which is a continuation-in-part of patent application Ser. No. 180,790, filed Sept. 15, 1971, entitled PRODUCT ISOLATED AEROSOL CONTAINER AND METHOD OF MANUFACTURE (now abandoned), and is directed to the container.

BACKGROUND

The well known aerosol dispensing package has achieved wide acceptance and success. At present, a great number of products are distributed in aerosol packages, many of the products being heretofore deemed unsuitable for aerosol dispensing. To name a few, paints, insecticides, beauty aids, powders, food products, window cleaners, etc., have all undergone revolutionary packaging changes and are now dispensed in aerosol packages. In a conventional aerosol dispensing package, a rigid tubular member, usually of metal, is partially filled with the product to be dispensed and a dispensing valve is attached to the open end of the package. Thereafter, a suitable propellent in the form of a gas is introduced into the package which exerts a force against the product tending to urge the product out of the package through the dispensing valve. Upon actuation of the dispensing valve, the force exerted by the propellent will urge the product from the aerosol package in the form of a fine mist or spray.

Since the foregoing described aerosol packages have achieved great acceptance in the consumer market and enjoy a high degree of success, increasing effort has been directed to the fabrication of packages of this type. In the matter of economics, the success of the item is diminished or even eradicated if the cost of the dispensing package is out of proportion to the cost of the product to be dispensed. That is to say, the convenience of an aerosol package may be overridden by economic considerations when, for example, a twenty cent package is employed to dispense five cents worth of material.

Aerosol packages take many and varied forms and a primary consideration is the possible reaction between the propellent and the product to be dispensed. In many cases relating to the dispensing of non-edible products, the selection of the propellent receives little attention. However, in the packaging of volatile products, highly reactive products, edible products, etc., much attention may be directed to the selection of the propellent since reactions between the propellent and the product may oftentimes occur. This reaction results in contamination and degradation of the product and as such, is, of course, highly undesirable and to be avoided.

Accordingly, the need has arisen for a barrier package which will maintain the propellent separated from the product and a surrounding, usually rigid, container body.

One approach is by use of a piston. This has not proved satisfactory because of the possibility, during handling, of the package becoming dented. Another approach involves the use of an elastic inner container forming a barrier between the product and the pressure fluid. Two examples of this approach are U.S. Pat. Nos. 3,393,842 and 2,953,304, both of which utilize a product filled bag the rim of which is clamped between metal parts of the package. Difficulty has been encountered in insuring a complete seal as the bag may be cut during assembly.

The other examples are U.S. Pat. No. 3,189,231 and 3,415,425, in which the product is contained in the package above an initially compacted and folded expansible barrier containing the pressure fluid. The first of these patents indicates the need of a piston as well as the barrier, with attendant increase in package size. Another example is U.S. Pat. No. 3,549,058 wherein the metal package receives a liner having corrugated walls and a neck portion which fits into the neck of the package. While a rather complete liner is provided, difficulty is encountered in assembly as the liner neck sometimes slips into the package when the dispensing valve closure is secured. Examples of other barrier packages include 3,145,884; 3,393,842; and 3,541,581.

To date, barrier packages have had but limited commercial success which can be attributed at least in part to the differences in manufacturing, evidenced by high package failure rates and excessive package costs.

One difficult problem inherent in barrier dispensers involves premature closure of the outlet valve by the barrier so as to prevent full evacuation of the product, that is, a portion of the barrier may be forced over the outlet opening before all of the product has been discharged so that the remaining portion of the product is entrapped.

A second problem inherent in barrier dispensers involves permeability of the barrier. The nature of the barrier materials used, the propellents used, and the products to be dispensed require extensive efforts to avoid or reduce permeability. In addition, many of these products are required to have shelf lives in excess of 24 months.

A third problem inherent in barrier dispensers involves the integrity of the barrier under various conditions including filling and drop testing.

SUMMARY

The present invention and a companion application Ser. No. 384,738, filed Aug. 1, 1973, entitled METHOD OF MANUFACTURE OF A BARRIER PACKAGE, now issued as U.S. Pat. No. 3,896,602, are directed to a barrier package and method of manufacture which solves the problems inherent in previous packages of this type and which may be manufactured at minimum cost while also minimizing the production of defective packages. The invention is summarized in the following objects:

First, to provide a barrier package and method of manufacture wherein appropriate walls of the package receive a formed-in-place controlled release coating, portions of which release from the inner surface of the package to form a barrier between the propellent and the product to be dispensed.

Second, to provide a product and method as indicated in the preceding object, wherein the coating may be applied by various coating application techniques such as pouring the coating material into the package, then draining excess material, or by spraying the material into the package, or by blow-molding the material until limited by the walls of the package.

Third, to provide a barrier package which may be so arranged that the controlled release coating or selected portions thereof may adhere with a predetermined force to the surface of the package, thereby necessitating application of a predetermined tension on the coating in order to release additional coating having controlled deformation to insure that the dispensing means does not become prematurely clogged by the released coating.

Fourth, to provide a barrier package and controlled release coating, with controlled deformation to insure continued communication between the product and the dispensing valve until the maximum quantity of the product has been dispensed.

Fifth, to provide a barrier package whose cost of manufacture is essentially no greater than conventional non-barrier pressure packages adaptable to mass production techniques.

Sixth, to provide unique and improved concepts in barrier package construction and to the structural incorporation of novel principles contributing to the unique function of the container components.

Seventh, to provide a barrier package that can be produced on manufacturing equipment presently in use and to utilize standard readily available components and raw materials.

Eighth, to provide a barrier package at an extremely low manufacturing cost, thereby making it practical to package many products that heretofore have not been available in pressurized packages.

Ninth, to provide a barrier package, at a low manufacturing cost, with controlled permeability to insure maximum barrier properties over the life of the product.

DESCRIPTION OF THE FIGURES

FIG. 22 is a chart comparing the present invention with the prior art in regard to the permeability potential of a package stored for 21 months.

FIG. 23 is a chart comparing the present invention with the prior art in reagrd to the barrier area exposed to product and propellent during product life.

DETAILED DESCRIPTION

Figure 1:
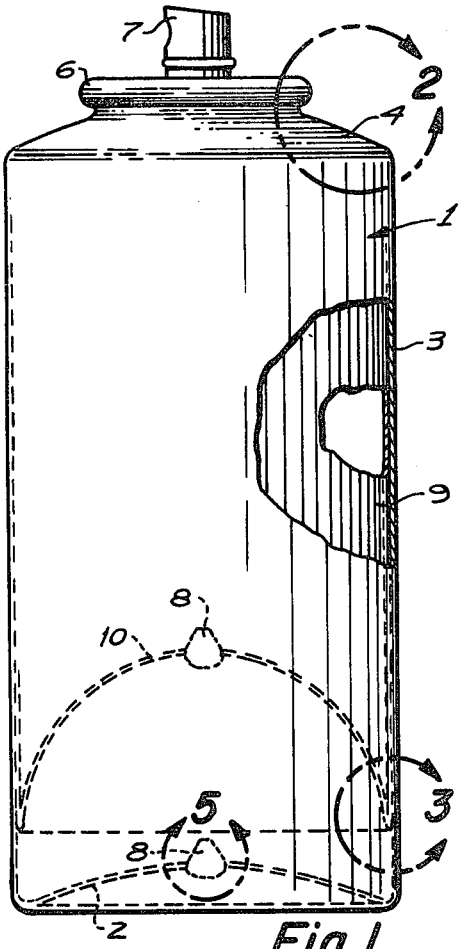
FIG. 1 is a side view with a portion in section showing one embodiment of the barrier package.
Figure 2:
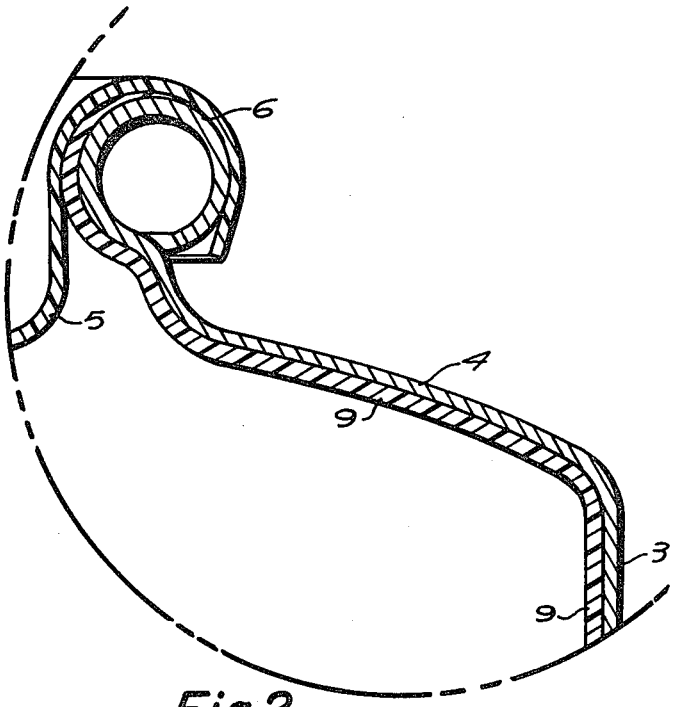
FIG. 2 is an enlarged fragmentary sectional view taken within circle 2 of FIG. 1.
Figure 3:
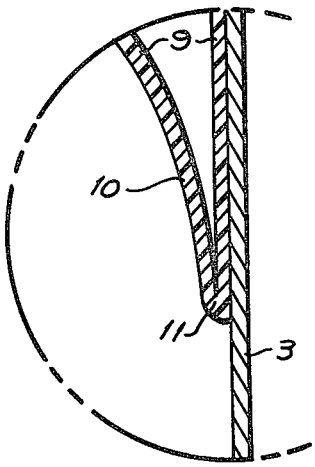
FIG. 3 is another enlarged fragmentary sectional view taken within circle 3 of FIG. 1.
Figure 5:
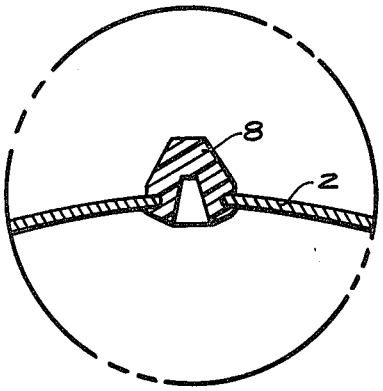
FIG. 5 is an enlarged fragmentary sectional view taken within 5—5 of FIG. 1.

Reference is first directed to FIGS. 1, 2, 3 and 5 which illustrates one embodiment of the barrier package. A metal container or package 1 is provided having upwardly concave bottom 2, a cylindrical side wall 3, and peripheral top wall 4. The container or package may be formed in a conventional manner by mold forming in a single piece or the bottom and top walls may be separate members and joined to the cylindrical wall in a conventional manner.

The peripheral top wall may receive a conventional closure member 5 joined hereto by conventional rolled connection 6. Mounted in the closure member 5 is a dispensing valve 7 which also may be conventional. Examples of such valves are disclosed in the following U.S. Pat. Nos. 2,615,597; 2,704,172; 2,739,841; 2,877,936; 2,906,449; 3,132,774; 2,678,147; 2,753,214; 2,772,819; 3,247,261 and 2,947,126. Fitted in the bottom wall is a conventional pressure fluid filler valve 8.

In the exercise of the present invention, the inner surfaces of the bottom wall 2, side wall 3 and peripheral top wall 4 receive formed-in-place, controlled release coating 9 which may be formed of a variety of materials. The composition of the material may vary substantially depending upon the product to be dispensed.

The package is filled with the product to be dispensed to a predetermined level. Thereupon the closure member 5 is secured to the top wall 4. Preferably a portion of the coating at least partially covers the top wall which receives the closure member 5 so as to be clamped therebetween within the rolled connections 6 and insure a good seal. After this is accomplished, a pressure fluid is injected through the filler valve 8. As indicated previously, the filler valve may be conventional. The filler valve may be provided with a slit which may be opened by insertion of a small filler tube. After the container 1 is pressurized, the filler tube is withdrawn and the internal pressure forces the sides of the slit together so as to contain the pressure fluid. As the pressure fluid is introduced into the container or package, it releases coating 9 from a portion of the inner surface of the package. When the package is fully pressurized, a portion of the controlled release coating has released from the surface of the package to form barrier 10. It is preferred that the barrier assume a dome shape rather than merely wrinkle as it is displaced upward by the pressure fluid and the escape of the fluid product. This condition is enhanced by so formulating the controlled release coating 9 as to be semi-adhesive so that a predetermined force is required to release the coating from the dispenser wall and in doing so produce a folded margin 11.

If desired, a semi-adhesive lamination 12 may be applied to the inner surface of the package prior to application of the controlled release coating 9. The adhesive may be weak and therefore tend to separate from itself, or its bond with either the package surface or the controlled release coating surface may be weak so as to strip therefrom. One purpose for the semi-adhesive bond between the controlled release coating and the package wall or intervening semi-adhesive is to minimize the chance that a portion of the barrier will be forced into contact with the dispensing valve 7 and close the valve so that the remaining fluid product cannot be dispensed.

Figure 6:
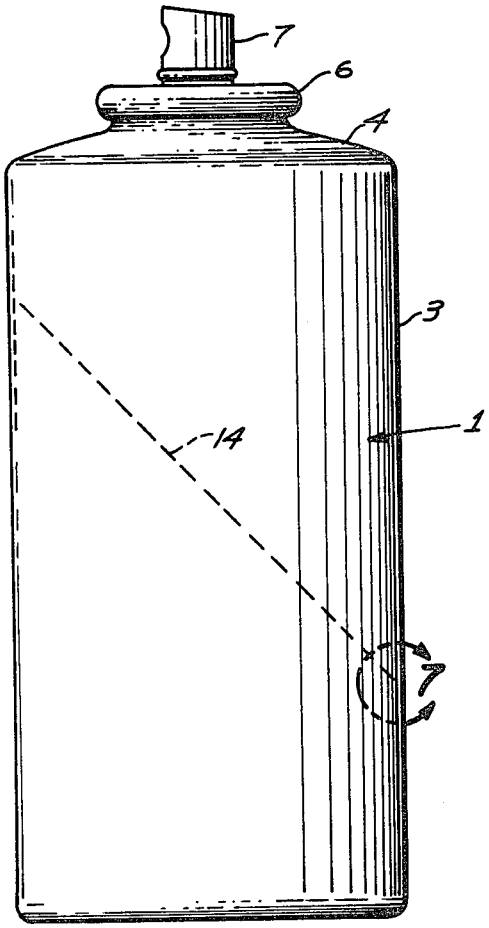
FIG. 6 is a side view showing another embodiment of the barrier package.
Figure 7:
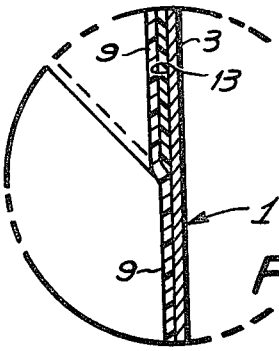
FIG. 7 is an enlarged fragmentary sectional view taken within circle 7 of FIG. 6 showing the package in its initial condition.
Figure 10:
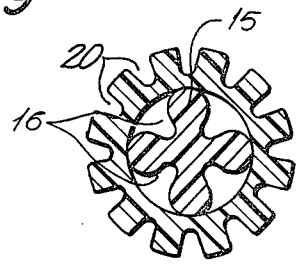
FIG. 10 is an enlarged transverse sectional view taken through 10—10 of FIG. 9.
Figure 8:
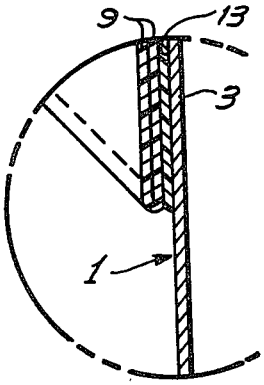
FIG. 8 is a similar enlarged fragmentary sectional view showing the package in its depleted condition.
Figure 11:
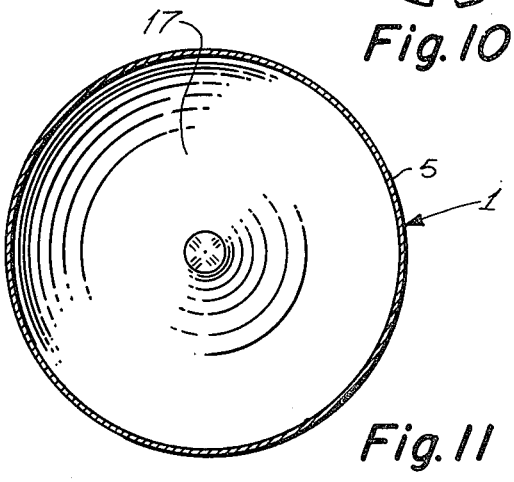
FIG. 11 is a transverse sectional view taken through 11—11 of FIG. 9 showing the bottom view of the barrier early in the course of depletion of the contents.

Another approach to this problem is indicated in FIGS. 6, 7 and 8. The construction is essentially the same as that in FIGS. 1, 2 and 3, except that the upper portion of the package is provided with an adhesive lamination 13. The adhesive 13 is intended to provide a permanent bond and is disposed under that portion of the controlled release coating 9 which need not release from the inner surface of the package, that is, if the barrier portion of the controlled release coating is folded within the remaining still intact portion of the controlled release coating, the intact portion will occupy approximately one half the total internal area of the package. By applying the adhesive to essentially one half the internal area of the package in an appropriate pattern, the possibility that the barrier will prematurely close the dispensing valve can be greatly reduced. One solution is to provide an inclined boundary edge 14 as indicated in FIGS. 6, 7 and 8. This may be done by dip coating the adhesive with the package placed at an angle.

Reference is now directed to the embodiment shown in FIGS. 9, 10, 11, 12 and 13. Previous attempts have been made to provide a central tube in barrier packages serving a purpose similar to the dip tube used in conventional nonbarrier packages; however, the presence of a central tube often prevented discharge of the entire product. As shown in FIGS. 9 through 12, a central stem 15 is provided having longitudinal grooves or channels 16. The stem is fitted into a tubular extension of the dispensing valve 7.

Figure 9:
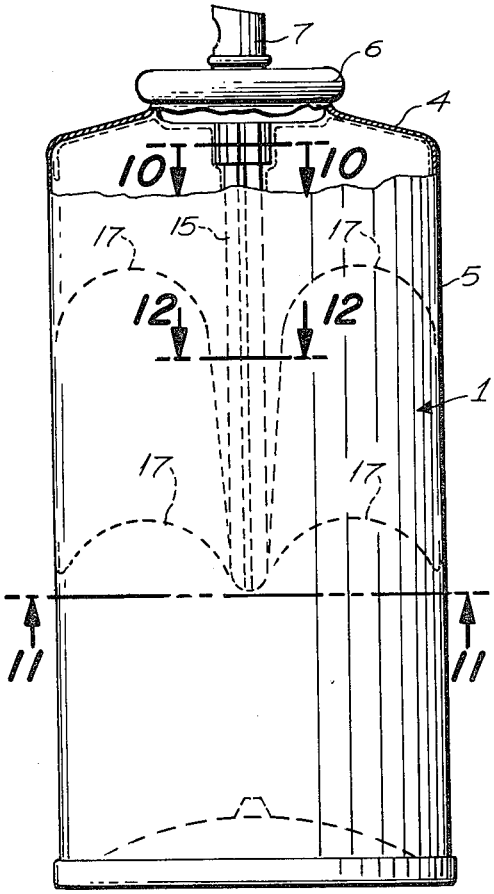
FIG. 9 is a side view of a further embodiment of the barrier package having a central stem.
Figure 13:
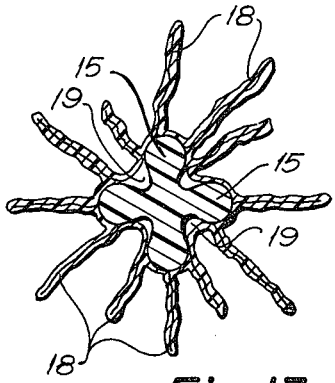
FIG.13 is a sectional view of the stem showing a modification thereof.

As the product is depleted, the central portion of the barrier initially engages the end of the stem to form a toroidal dome 17. On further depletion, the barrier, while retaining its toroidal dome shape, forms essentially radial folds 18 as indicated in FIGS. 9 and 13, which diminish toward the periphery of the barrier. Because the barrier is under tension the folds do not encapsulate any product, but their opposite sudes progressively fold together urging the product toward the stem 15 and the grooves 16. Although the barrier tends to cling to the surface of the stem the grooves 16 form passageways underlying the barrier as indicated by 19. In order to insure maximum discharge of the product, the tubular extension of the dispensing valve 7 may also be provided with channels 20. The length of the stem is approximately two-thirds to three-fourths the lenght of the container so that the barrier is capable of contacting the first wall portion as the last of the product is discharged without placing additional stress on the barrier.

The stem 15 is readily extruded at low cost and may be tubular; if so, the channels 16 may be perforated; however, at increased cost. Also a tube 21 of circular cross section, as shown in FIG. 12, may be perforated throughout its length; however, because of the large number of perforations required to insure against entrapment of product, such perforations materially increases the cost.

The controlled release coating 9 is applied to the inner surface of the package in the previously described embodiments covers the entire surface of the package except for the closure member 5. Thus only the inner surface of the closure member need to be such as to be compatible to the product dispensed. That is, in the embodiments so far described, the barrier and the internal surface of the controlled release coating from a product chamber, whereas the other side of the barrier and the internally exposed walls of the package form the propellent chamber.

The controlled release coating 9 may be introduced in several ways. A simple procedure is suggested in FIG. 14 wherein the liquid coating is merely poured into the package as from a nozzle 22. The liquid may be caused to completely fill the package. Thereupon, the package is inverted to remove the liquid material, leaving the controlled release coating. Depending upon the nature of the coating, heat may be applied to effect solidification and produce a wall of the desired thickness.

Figure 12:
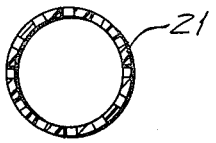
FIG. 12 is an enlarged fragmentary sectional view taken through 12—12 of FIG. 9.
Figure 15:
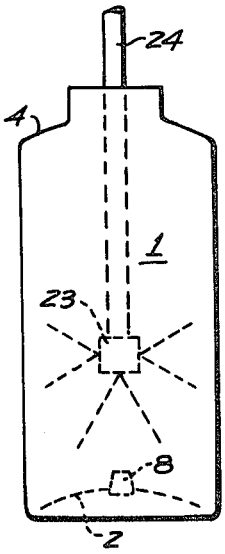
FIG. 15 is a similar side view showing a package in the course of receiving a spray supplied coating.

Another procedure as shown in FIG. 15 involves the use of a spray head 23 suspended from a stem 24 for entrance through the top wall 4 or bottom end of the package as suggested in FIGS. 12 and 13. The spray head or the package 1 preferably rotates to effect a uniform coating. Here again, heat may be applied to control the thickness of the controlled release coating.

Figure 17:
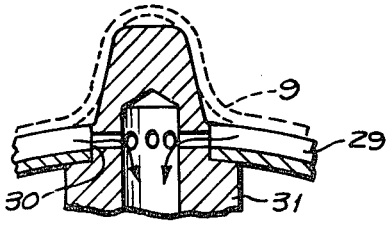
FIG. 17 is an enlarged fragmentary sectional view taken through 17—17 of FIG. 16.
Figure 18:
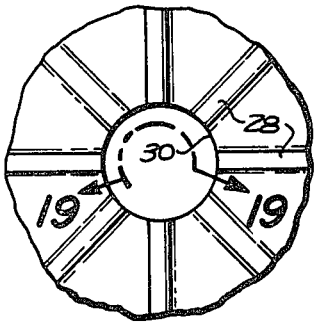
FIG. 18 is an enlarged fragmentary plan view taken from 18—18 of FIG. 16.
Figure 16:
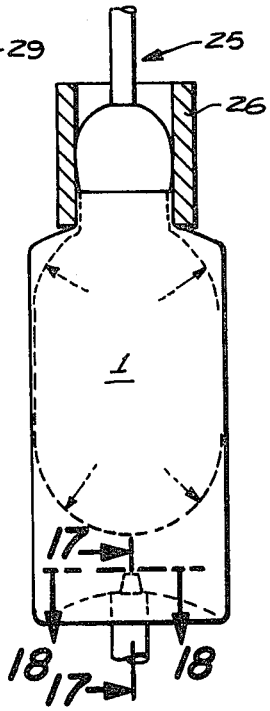
FIG. 16 is a similar view of a package in the course of receiving an internal coating applied by a blow-molding technique.

Another procedure as suggested in FIGS. 16, 17 and 18, involves a blow-molding technique which may use a conventional blow-mold fitting 25, having a sleeve 26 to surround the axially extending top portion of the package, or to surround the bottom end of the package. The coating in the form of a bubble is introduced into the package 1 and is forced against the inner walls thereof, progressively forcing air out the top and bottom of the package. To prevent entrapment of air at the periphery of the bottom wall, the bottom wall may be provided with ribs 28 forming small air passages between channels 29 between the blow-molded coating and the channels communicating with a central opening 30, corresponding to the opening which receives the filler valve 8. During the loading operation, the central opening is closed by a plug 31 having passages communicating with the channels 29.

Once the controlled release coating has been applied, a filler valve similar to the filler valve 8 may be inserted. A sealing fit is provided by corrugating portions of the filler valve body to conform to the ribs 28 and channels 29.

The method which forms a part of this invention centers around the step of forming-in-place a controlled release coating within the container or package 1 and then causing the controlled release coating to release progressively from the walls as the product is dispensed or as the propellent is introduced into the package. The method also includes the alternative steps of filling the package with the coating material and pouring out excess material or by spray coating or by mold-blowing the controlled release coating into place.

A further method of effecting formed-in-place coating on the interior walls of the dispenser involves electrostatically charging the package and introducing the coating material in the form of fine particles. This may be accomplished by a suitable spray head inserted in the manner of the spray head 33 shown in FIG. 15, or merely directed inwardly at the mouth of the package, as the charged particles will be drawn to the surface. An even controlled release coating can be produced for the charge at any point diminishes as the coating increases.

Figure 14:
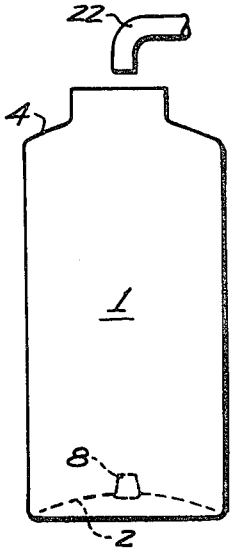
FIG. 14 is an essentially diagrammatical side view of the package in the course of receiving a liquid coating material.
Figure 19:
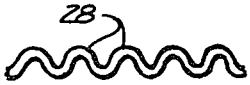
FIG. 19 is a fragmentary elevational view taken from circle 19—19 of FIG. 18.

Referring to FIG. 14, the liquid poured into the package may contain the coating in solution or as gas powder or a colloidal suspension.

Uniformity of the coating obtained by spraying or by pouring is enhanced by rotation of the package. Also, the package may be heated.

Suitable pressure packages of the invention comprises closed containers made of any appropriate material. For example, the package can be constructed of metal such as a conventional three-piece, tin-free steel aerosol package with a welded or soldered side seam, or one-piece drawn steel or aluminum package or a plastic package such as an injection molded copolymer of trioxane such as Celcon, or an injection blow molded acrylonitrile such as Barex, or an injection molded polyesters such as Valox. The package can be of many sizes and/or irregular shapes particularly the plastic packages. The invention is particularly useful for manufacturing irregularly shaped plastic barrier packages which are essentially nonpermeable.

Propellents useful in the present invention are volatile organic compounds or materials, of which many exist in the form of a gas at ordinary temperatures and pressures. They can liquify at lower temperatures or when under pressure in a package such as those described and claimed herein. Included among suitable propellents are aliphatic hydrocarbons, partially or wholly fluorinated and partially or wholly chlorofluorinated hydrocarbons which have vapor pressures ranging from about 5 to about 100 p.s.i.g. preferably 20 to 50 p.s.i.g., at about 70° F. Either a single compound or a mixture of two or more compounds can be used. And other homologs individually having vapor pressures outside the desired ranges set forth, can be used with other homologs, if the combined vapor pressure falls within such desired ranges. By way of illustration, kerosines and light mineral oils can be utilized. Gases such as carbon dioxide, nitrogen and air can be used. Thus, the term "propellent" used herein denotes liquified gaseous materials, e.g., propane and nonliquified materials, e.g. carbon dioxide.

Representative propellents are: aliphatic hydrocarbons, preferably saturated hydrocarbons, such as propane, butane, isobutane and cyclobutane; saturated fluorinated, and fluorinated and chlorinated, aliphatic hydrocarbons illustrated by: 1,1-difluoroethane; 1,2-dichloro-1,1,2,2-tetrachloroethane; trichlorotrifluoroethane; dichlorodifluoromethane; monochlorodifluoromethane; monofluoromonochloromethane; 1-monochlorodifluoromethane; monofluoromonochloromethane; 1-monofluoro - 1,1-difluoroethane; trifluoro ethyl chloride; and octafluorocyclobutane.

Regardless of which of the particular compounds or mixtures thereof are employed herein as propellents, it is not necessary to be concerned about the effect of the propellent on the physical or chemical properties of the dispensable product or their effect upon the surface or area to which the product is applied. This follows from the facts that the propellent or propellents are substantially completely isolated in the propellent section of the package, and that they do not come into contact with the product to be dispensed. Accordingly, in a pressurized package or container of shaving preparation manufactured in keeping with this invention, those compounds set forth above as propellents which cause a tingling sensation to the skin or instability of lather can be employed as propellents since they are completely isolated from the dispensable product.

In addition to the foregoing, the propellent can be provided by decomposition of a solid or liquid which upon activation generates gas. Typical liquids for use in such a system will include aqueous hydrogen peroxide solutions containing a decomposition agent such as ferrous amoneum sulfate. Useful other gas-producing materials include carbonates and bicarbonates which react with acid to liberate carbon dioxide gas, lithum hydride, which generates gas on contact with water, solid carbon dioxide and the like.

The controlled release coating of the invention is formed-in-place, integral with the inner surface of the package and substantially free from air entrapment. The coating is obtained using various application techniques, including:

a. Conventional hand techniques such as brush, roller, air and airless spray, b. various spray applications such as electrostatic and flame sprays, c. machine applications such as roller, knife and blade curtain, air knife and strip and coil coating, d. electrodeposition including anodic and cathodic process, e. powder coating including fluidized bed and electrostatic spray, f. non-aqueous dispersion coating, and g. hot melts and high energy curing including gamma ray, electron beam, ultraviolet, infrared, microwave, and induction heating.

The raw materials for controlled release coating include:

a. Resins such as: vinyl acetate, homo and copolymers with ethylene; acrylates dibutyl maleates fumarates, polyvinyl formal and polyvinyl butrayl; acrylic styrene, styrene-butadiene, polyvinyl chloride, alkyd polyesters, urethane, epoxy, polyamide, amino and phenolic, and b. polymers such as: vinylidene chloride, olefin polymers and copypolymers; polyethylene, polypropylene, ethylene copolymers, polybutadiene, polyimides, polyamide, polyester-imides and various rubbers.

In a preferred embodiment of the invention the controlled release coating is a laminate of various polymers and/or resins, and mixtures thereof which provide optimum release properties with maximum strength and optimum barrier properties specifically low permeability.

The integrity, release and low permeability properties of the controlled release coatings can be further modified by the addition of various secondary binder components such as plasticizers, rheology control agents, driers, surfactants, heat stabilizers, crosslinking agents, pigments, extenders and fillers.

Solvents for the controlled release coatings include: aliphatics, aromatics, esters, ketones and alcohols. Non-aqueous dispersions which use less organic solvent then solution coatings can be used.

Water based and solventless coatings are particularly attractive where pollution control is desired. Examples of the latter include: radiation cured one component fluids, two component liquid systems such as epoxies polyamides and powder coatings.

Controlled release coatings of the invention are characterized by a chemical/mechanical bond with the inner surface of the package. In a preformed embodiment, this bond is substantially free from air entrapment. The bond obtained is a function of the adhesive properties of the coating material and the nature of the inner surface of the package. For example, various portions of the inner surface can be pretreated with bond modifiers so as to selectively control the coating/inner surface bond. (See FIG. 3). Similarly, the coating can be constructed of laminates with that layer of the laminate that is in contact with the package inner surface having optimum bonding properties that compliment the inner surface pretreatment in order to obtain the desired release. (See FIG. 4).

Figure 4:
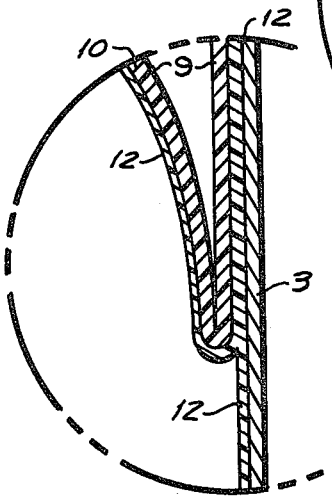
FIG. 4 is an enlarged fragmentary sectional view similar to FIG. 3 showing a modified construction.

Thus portions of the controlled release coating can be released with a minimal change in pressure such as shown in FIG. 4, while other portions of the coating remain integral with the inner surface irrespective of the change in pressure up to the total exhaustion of the contents of the package. (See FIG. 7).

The potential for permeability of either propellent, product or product components across the barrier is unexpectedly reduced with the controlled release coatings of the invention. The barrier which is formed with introduction of propellent comprises a small protion of the total surface area of the controlled release coating. This portion of the barrier is subjected to the severest permeability demands of any part of the controlled release coating since it is exposed to propellent longer than the remainder of the barrier formed when the product is dispensed. This initial barrier area, that is, that portion of the controlled release coating which is released from the package inner surface upon the introduction of propellent, can be further modified during the coating process to obtain improved anti-permeability properties. The anti-permeability control means which can be used include various additional layers of coating materials such as polyvinylchloride, polyimides, polyamides, polyesters, metallic films and the like and various combinations thereof. In a preferred embodiment of the invention the anti-permeability control means comprises a semi-rigid laminate of a coating material such as polyvinylchloride and an electrodeposited metal.

The heretofore unobvious advantages of the invention such as controlled release coatings and permeability control are particularly important to plastic barrier packages. That is, permeability of plastic package, per se, has been one of the primary restrictions in the commercialization of plastic aerosol packaging. Additionally, the exposure of the entire palstic package to a constant pressure has resulted in many long term shortcomings of plastic aerosols including those problems related to cold flow - creep, and physical changes in structure and the like. The use of controlled release coatings in combination with initial barrier formation to define a limited area for propellent containment is particularly useful in plastic aerosol packages. Since the techniques employed to reduce permeability of the initial barrier can also be used to reduce the permeability of the plastic package in the area defining the propellent prior to dispensing. Additionally, the controlled release coatings of the invention offer substantial advantages to plastic aerosol packages in overall permeability performance.

In the preferred embodiment of the invention, the barrier is not defined during filling of the product. That is, the controlled release coating is integral with essentially the entire inner surface of the package wall including the bottom wall 2 and substantially free from air entrapment. This is particularly critical to those embodiments of the invention which are useful in high speed under-the-cap filling methods, such as described in U.S. Pat. No. 2,947,626. Since there is no space between the coating and the inner surface of the package, the high pressures used to introduce product during filling will not rupture the coating of the invention which can occur with systems, characterized by bags or other means which are not integral with the package wall and have air entrapped between the inner surface of the package and the bag.

Figure 20:
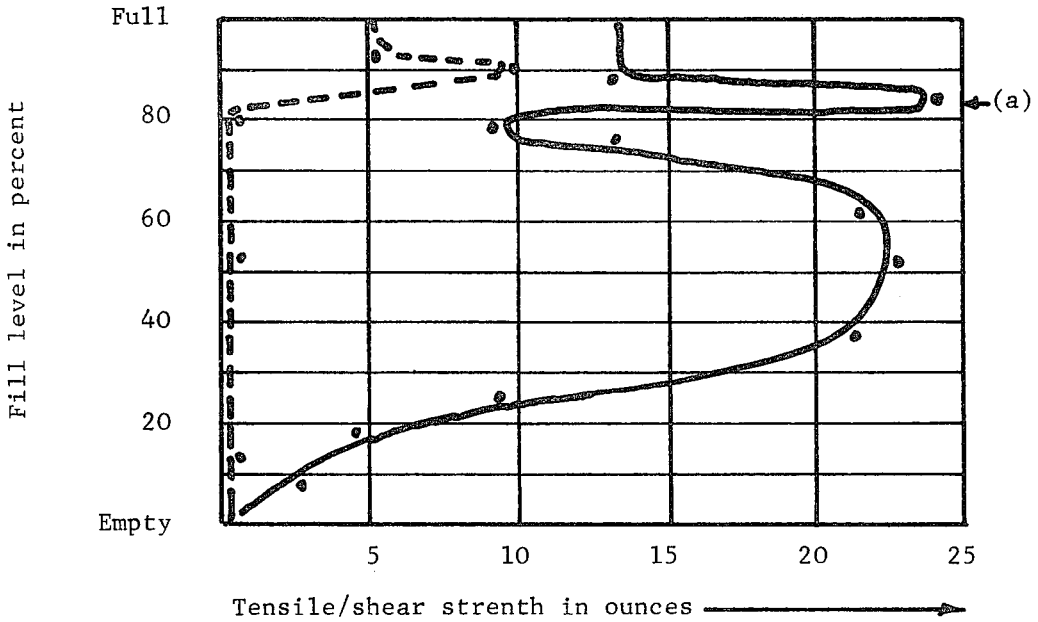
FIG. 20 is a chart comparing the present invention with the prior art in regard to the tensile/shear strength required during filling.

Reference is made to FIG. 20 which is a chart illustrating the advantages of the present invention which are obtained during filling of the package with a food topping at about 120 to 180 p.s.i.g. That is, a formed-in-place, controlled release, polyester modified coating of the invention which is integral with the dispenser inner surface and substantially free from air entrapment requires a maximum tensile shear/shear strength of about 10 oz. at approximately the 90% fill level. In constrast, a bag barrier package which is supported at the valve cup requires a tensile/shear strength over 20 oz. at about the 40% fill level and again at about the 80% fill level.

After the package is filled and the dispensing valve secured to the package, the barrier is defined by introducing the propellent through propellent filling means 8. Such methods of introducing propellent are described in detail in Drug and Cosmetic Industry, August, 1967, and Canadian Pat. Nos. 751,725. At this time a portion of the controlled release coating releases from the package inner surface to define a container for the propellent. (See FIG. 3 or 4). Upon actuation of the dispensing valve a pressure increase is created across the barrier 12, the barrier being defined as that portion of the controlled release coating which is no longer integral with the package inner surface. The controlled release coating responds to this pressure increase by releasing from the inner surface of the package to the extent necessary so that there is substantially no pressure differential across the barrier. (See FIG. 8)

In another embodiment of the invention deformation of the barrier is controlled by the combination of the controlled release properties of the coating and the physical properties of the barrier, its elastomeric properties, and the inclusion of preferential deformation means such as the various ribs and the like.

Figure 21:
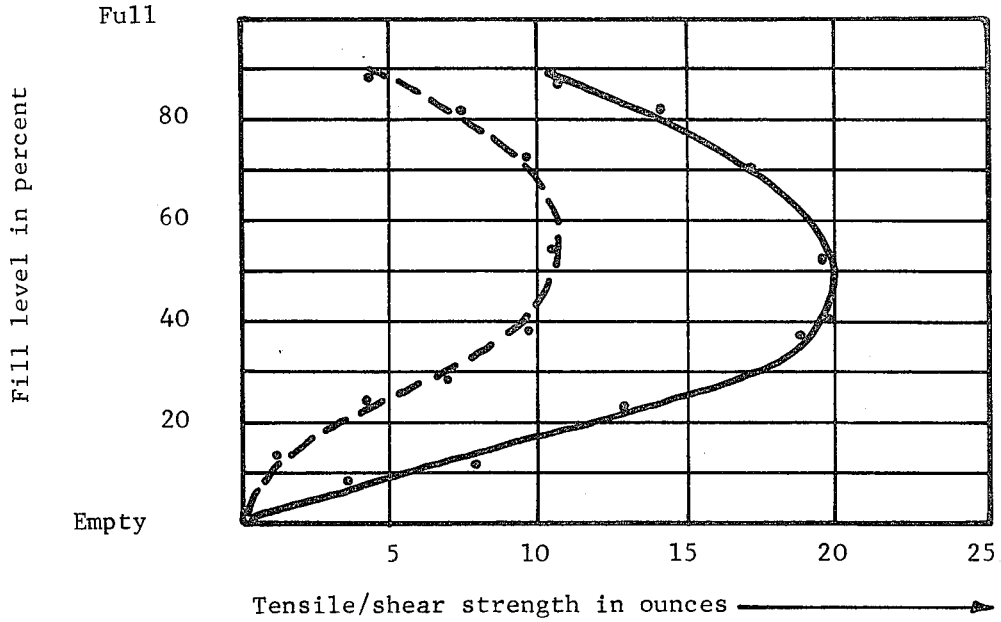
FIG. 21 is a chart comparing the present invention with the prior art in regard to the tensile/shear strength required at various fill levels under drop test conditions.

Reference is now directed to FIG. 21 which is a chart illustrating the tensile/shear strength required at various fill levels under drop test conditions. This chart illustrates the unobvious advantages of the present invention which are obtained when a package constructed in accordance with the invention is drop tested at 10 g. That is, when a 7 oz. barrier package having a modified polyester controlled coating is filled with a tooth paste to various levels, charged with a hydrocarbon propellent and drop tested, the tensile/shear strength requirements of the integral coating of the present invention were slightly greater than 10 oz. at 60% fill level. In contrast, a bag barrier package in which the barrier is supported at the valve cup and filled with the same product and charged with the same propellent required a tensile/shear strength of over 20 oz. at the 60% fill level.

Reference is now directed to FIG. 22 which is a chart illustrating the advantages in anti-permeability obtained with a barrier package of the present invention. That is, the potential for permeability occurring across the barrier is dramatically reduced in the controlled release coating of the invention. Until the package is actuated and a product dispensed approximately 9% of the controlled release coating has been released to form the barrier and contain the propellent. This portion of the controlled release coating could be further modified to control permeability. In contrast, a bag barrier package which is supported at the valve cup has up to 98% of the bag liner exposed to product and propellent prior to the first actuation. When the permeability potential of these two barrier packages are plotted over the average shelf life of a package (21 months) and during an average use period of three months, the advantages in reduced permeability potential of the invention is illustrated in FIG. 22.

FIG. 23 is a chart which illustrates the barrier area exposed to product and propellent during product life by use of the present invention in comparison to use of an unsupported bag or bellows system. More particularly, the percent of polyester modified coating released to form a barrier at various percentages of product dispensed is compared with an unsupported bag. In both cases the product was dispensed from a seven ounce aerosol package filled with fluoride containing tooth paste and charged with a blend of fluorinated hydrocarbon porpellents.

Certain attributes of dispensers incorporating the present invention are compared to various commercially available dispensers in Table I which follows:

TABLE I

| FACTORS TO BE COMPARED | TYPE OF BARRIER PACKAGE | | |
|---|---|---|---|
| | Package of the Invention | POWR-FLO Package U.S. 3,393,842 | SEPRO Package U.S. 3,451,592 3,549,058 |
| Cost for 7 oz. (Including filling) | 0.2–0.8 premium over 3 piece package | 2–4 premium over 3 piece package | 4–6 premium over 3 piece package |
| Manufacturing Characteristics | Conventional package coating equipment can be adapted | Special equipment required to stuff bag into package and attach to chime | Special equipment to stuff bag into package and attach at valve cup. |
| Barrier Formation | Coating applied to package inner wall-uniting with the wall as integral part see photograph Stage 1 | Cut and formed bag from sheet stock with sealed bottom seam. See photograph Stage 1 | Blow molded bag See Photograph Stage 1 |
| Means of attaching barrier to package | Coating bonded to & integral with substantially all of the package inner wall except for valve area. See photograph Stage 1 | Bag secured to upper chime of package & suspended in package. See photograph Stage 1 | Bag secured at valve cup and suspended in package. See photograph Stage 1 |
| Air/Propellent entrapment | Less than about 20% of barrier surface is exposed to propellent. Since coating is integral with package inner wall there is substantially no air entrapment. See Photograph Stage 1 | Propellent/air surrounds approx. 70% of bag surface. See photograph Stage 1 | Propellent/air surrounds over 80% of bag surface. See photograph Stage 1 |
| Barrier Properties | Permeability controlled by type, number and amount of coatings. | Permeability can be improved with laminated stock. | Most gases and liquids diffuse thru Conoloy bag wall - will not contain peppermint flavor-nor will it restrict propellent from contaminating product |

| FACTORS TO BE COMPARED | TYPE OF BARRIER PACKAGE | | |
|---|---|---|---|
| | Dispense of the Invention | Power Flow | Sepro |
| Barrier Options | Anything that can be sprayed to produce a coating with controlled release propeties is suitable. | Limited to bag forming capabilities and sheet stock availabilities. | Limited to molding capabilities & related "liner" forming techniques |
| Deformation/ discharge potential | Controlled release and controlled deformation result in approx. 1% by weight of product not discharged. | Random deformation see photograph, note Stage 3 approx. 9% by weight of product cannot be discharged | Convulutions molded into bag, see photograph note Stage 3, 14% by weight of product cannot be discharged. |
| Stress Areas | No stress area common to suspended liners see FIG. 21 | Attachment at chime area a performance vulnerability See drop test performance in FIG. 21 | Attachment at valve cup area definitely a performance vulnerability, See drop test performance described in FIG. 21 |
| Filling | High pressure, high speed, under- | Low pressure, low speed liquid fill- | Low pressure, low speed, liquid filling with |

TABLE I-continued

| | | | |
|---|---|---|---|
| | the-cap filling with no effect on barrier integrity, See FIG. 20 Filling speeds up to 800 per min. | ing, High pressure filling ruptures attachment at chime See FIG. 20 Filling speeds approx. 160 per min. | spinning of package required for filling convulutions, High pressures rupture attachment at valve cup. See FIG. 20 Filling speeds approx. 140 per min. |
| Package size, Shape & type of material | Adaptable to any shape, size or material with slight modification to coating equipment | Equipment required for securing bag to chime requires extensive change parts to change diameter and/or length of bag | Limited by availability of molds for the bag. Each size package requires a new mold for bag |

The barrier packages of the present invention are particularly suitable for dispensing flowable materials such as liquids, pulps, pastes, powders and the like, including products such as food stuffs, cosmetics, pharmaceuticals, toothpastes, mouth wash, shaving cream, shampoo, antiperspirant, caulking compounds, adhesives and the like. Illustrative examples of such products packaged in the dispensers of this invention are set out in Table II below in which the products are, Prefoamed shaving cream, Toothpaste, Food topping, Skin cream, Cough medicine and Caulking compound:

TABLE II

| FACTORS TO BE COMPARED | Prefoamed Shaving Cream | Toothpaste | Food Topping | Skin Cream | Cough Medicine | Caulking Compound |
|---|---|---|---|---|---|---|
| Package | Three piece steel with side seam | One piece drawn steel | One piece drawn aluminum | Injection molded Celcon | Injection/blow molded Celcon | Three piece steel with side seam |
| Controlled Release Coating | Polyethylene/ acrylonitrite laminate | Vinyl acetate/ polyethylene/ polyimide laminate | Acrylate/polyvinyl chloride | Acrylic styrene/ polyamide laminate | Dibutyl meleate/ urethane/poly-propylene | Polyester laminate |
| Coating Application Method | Spray | Dip | Spray-aqueous dispersion | Spray | Spray | Dip |
| Coating Thickness in Mils | 4–6 | 8–10 | 6–9 | 2–4 | 3–6 | 3–6 |
| Propellent | Blend of hydrocarbons $C_3$–$C_4$ | Fluorinated hydrocarbons | Non-condensable gas | Fluorinated/ hydrocarbon/ hydrocarbon blend | Non-condensable gas | $C_3$–$C_4$ hydrocarbon blend |
| P.S.I.G. | 25 | 60 | 90 | 30 | 90 | 46 |
| Percent Product Dispensed | 90–94 | 92–96 | 89–92 | 96–98 | 90–94 | 90–92 |
| Barrier Deformation | Controlled by a series of longitudinal reinforcements | Circumferential spiral reinforcements | Combination of annular and longitudinal reinforcements | No special provisions | Pretreatment of portion of inner surface/longitudinal reinforcements | Combination of pretreatment of portion of dispersion inner surface and reinforced laminate |
| Air Entrapment | Less than 1% | Insignificant | Insignificant | Insignificant | Insignificant | Less than 1% |

As the chart illustrates, the percent of controlled release coating ranged from 20% to 50% exposed to the propellent; whereas, the unsupported bag maintained an exposure greater than 80%.

While particular embodiments of this invention have been shown and described, it is not intended to limit the same to the details of the construction set forth, but instead, the invention embraces such changes, modifications and equivalents of the various parts and their relationships as come within the preview of the appended claims.

I claim:

1. A disposable aerosol container comprising:

a. a container member including a first wall portion having a product inlet and discharge opening, a second wall portion having a propellent inlet opening and a third connecting wall portion positioning the first and second wall portions in spaced confronting relation;

b. a product discharge valve for the product inlet opening;

c. a propellent inlet means for the propellent inlet opening;

d. a formed-in-place coating adhesively and sealingly bonded initially to the inner surface of the second and third wall portions of the container member;

e. a fluid product isolated from the inner surface of the container member in the region of said coating and having a volume approximately equal to the total volume of the container member less the volume of a pressurized propellent required to discharge the product from the container member;

f. a pressurized propellent, having a potential volume greater than the volume of the container member, interposed between the coating and second wall surface of the container member;

g. the coating having greater strength than its bond with the inner surface of the container member whereby, upon introduction of the pressurized propellent, the coating is progressively peeled from the second wall portion of the container member only to the extent required to admit the pressurized propellent and to form a dome shaped barrier of limited area relating to the initial pressurized volume of the propellent, the barrier also forming a peripheral zone merging into the intact coating, said barrier, when subject to simultaneous discharge of the product and expansion of the propellent, being placed under tension sufficient to cause progressive peeling of the peripheral zone from the connecting wall portion of the container member, said tensioned barrier and the peripheral peeling causing the barrier to retain its dome shape and prevent isolation of portions of the product from the discharge valve, whereby the maximum quantity of the product is ultimately discharged from the container member;

h. a stem secured to the central region of the first wall portion and extending therefrom toward the barrier;

i. the barrier, during movement toward the first wall portion on discharge of the product, initially engaging the extremity of the stem causing the barrier to surround the stem and assume a toroidal dome shape, continued movement of the barrier causing the central portion of the barrier to fold about the stem while maintaining its toroidal dome shape;

j. the stem including means forming with the folded portion of the barrier at least one passageway communicating with the discharge valve and preventing entrapment of the product, and the length of the stem is in the order of two-thirds to three-fourths the spacing between the first and second wall portions.

2. A disposable aerosol container as defined in claim 1, wherein:

a. the passageway forming means are longitudinally extending channels.

3. A disposable aerosol container as defined in claim 1, wherein:

a. the stem is tubular and provided with a plurality of perforations throughout its length to form a plurality of said passageways.

* * * * *